US007066754B2

(12) United States Patent
Beck et al.

(10) Patent No.: US 7,066,754 B2
(45) Date of Patent: Jun. 27, 2006

(54) PRINTER CABLE AND ASSOCIATED STRAIN RELIEF COLLAR FOR CREATING A RUGGEDIZED CONNECTION FOR AN ELECTRICAL TERMINAL OF A PRINTER AND ASSOCIATED METHODS THEREFOR

(75) Inventors: David Beck, Exeter, RI (US); Michael L. Lamontagne, Johnston, RI (US); Roy Patrick Lyman, Coventry, RI (US)

(73) Assignee: ZIH Corp., Hamilton (BM)

( * ) Notice: Subject to any disclaimer, the term of this patent is extended or adjusted under 35 U.S.C. 154(b) by 0 days.

(21) Appl. No.: 10/901,686

(22) Filed: Jul. 29, 2004

(65) Prior Publication Data

US 2006/0025008 A1 Feb. 2, 2006

(51) Int. Cl.
*H01R 13/213* (2006.01)

(52) U.S. Cl. ..... 439/314

(58) Field of Classification Search ..... 439/314, 439/315–319, 502, 452

See application file for complete search history.

(56) References Cited

U.S. PATENT DOCUMENTS

| | | | | |
|---|---|---|---|---|
| 4,135,776 | A | 1/1979 | Ailawadhi et al. | |
| 4,165,911 | A | 8/1979 | Laudig | |
| 4,441,775 | A | 4/1984 | Walters | |
| 4,444,454 | A | 4/1984 | Horowitz | |
| 4,940,424 | A * | 7/1990 | Odbert | 439/369 |
| 5,378,882 | A * | 1/1995 | Gong et al. | 235/462.45 |
| 6,563,762 | B1 * | 5/2003 | Williams | 367/106 |
| 6,699,063 | B1 * | 3/2004 | Lebender | 439/451 |
| 6,705,896 | B1 * | 3/2004 | Chang et al. | 439/610 |
| 6,733,337 | B1 | 5/2004 | Kodaira | |
| 6,746,273 | B1 * | 6/2004 | Liu et al. | 439/502 |
| 6,800,809 | B1 * | 10/2004 | Moe et al. | 174/102 R |
| 6,861,590 | B1 * | 3/2005 | Rossi | 174/113 R |

OTHER PUBLICATIONS

RS232 Data Interface, a Tutorial on Data Interface and cables; Jul. 12, 2004; pp. 1-21; http://www.arcelect.com/rs232.htm.

Molex® RJ-45 Field Wireable Ethernet Connectors; Jul. 5, 2003; 2 pages; from http://www.molex.com.

* cited by examiner

*Primary Examiner*—Gary F. Paumen
(74) *Attorney, Agent, or Firm*—Alston & Bird LLP

(57) ABSTRACT

An electrical connection for communicating between electrical terminals is provided, as is a collar for retaining the cable of such a connection and associated methods. The connection can include a first modular connector engaged to a first electrical terminal of a printer, a second connector engaged to a second terminal, and a cable extending between the first and second connectors. The first terminal of the printer can be configured to communicate via a first plurality of electrical contacts using a USB protocol and via a second plurality of electrical contacts using another protocol. In some cases, a third connector can be provided on the cable such that the first terminal can communicate to the second connector using the first protocol or to the third connector using the second protocol. The collar can be slidably disposed on cables of various configurations and engaged to a terminal to secure one of the connectors on the cable to the terminal. Further, a reinforcement member can be provided to support the cable and/or one or more of the connectors.

43 Claims, 8 Drawing Sheets

PRINTER CABLE AND ASSOCIATED STRAIN RELIEF COLLAR FOR CREATING A RUGGEDIZED CONNECTION FOR AN ELECTRICAL TERMINAL OF A PRINTER AND ASSOCIATED METHODS THEREFOR

BACKGROUND OF THE INVENTION

1. Field of the Invention

The invention relates to the electrical connection of a printer and, more particularly, to the selective formation of an electrical connection to a terminal of a printer using a ruggedized printer cable and associated strain relief collar.

2. Description of Related Art

A variety of electrical cables and similar connection members are available for connecting printers to devices including computers, computer peripheral devices, network devices, and the like. A conventional printer cable typically extends between first and second ends and includes a connector at each end. The connectors are configured to correspond to the mating terminals or ports of the printer and the opposite device to be connected. The connectors at the first and second ends of the printer cable can be the same or different, and each can be male or female in configuration.

One typical connection member used for connecting a printer cable to a terminal or port of a printer device is a universal serial bus (USB) connector. For example, a printer can define a USB terminal or port. A USB printer cable with a corresponding USB connection member at a first end can be connected to the printer port. The second end of the printer cable can be connected to an associated device, such as a computer, network device, or the like. That is, the second end can include another connector, such as a USB connection member, so that the second end of the printer cable can be selectively connected to, and disconnected from, any of various devices that may be used to transmit printing commands to the printer. As is appreciated in the industry, a USB protocol is generally used to communicate via the USB connection.

Various other electrical connectors and associated communication protocols are known. For example, another data interface protocol is RS-232, or Electronic Industries Association (EIA) 232, which is commonly used for communicating between data terminal equipment (DTE) such as a computer, and data circuit-terminating equipment or data communication equipment (DCE) such as a modem. Various types of connectors are used for communicating with the RS-232 protocol. For example, a male DB25 connector includes 25 conductive pins arranged in two rows, and a female DB25 connector includes 25 sockets that receive the corresponding pins of the male connector. Similarly, a DB9 connector includes 9 pins and sockets on the male and female connectors, respectively. The RS-232 protocol for connecting to or from a serial port with an 8 position modular jack (such as an RJ-45 connector) is defined by EIA-561. The RJ-45 connection member is similar to a conventional telephone jack but is wider and typically includes 8 conductive connections.

While the USB and RS-232 protocols and connectors have become commonplace in the field of computer related electronics, various other types of electrical connectors are also widely used, sometimes in the same or similar applications. For example, a computer or network device may be configured to communicate with a printer via a USB port, or by using another type of connector operating according to a different protocol, including various types of serial or parallel connections. Thus, a user making a connection, such as between a portable printer and a computer, may be required to provide any of various types of cables. Further, in some cases, a cable with different types of connectors at its opposite ends may be required if the printer and computer have dissimilar connectors.

In addition, while USB connectors and other similar connectors provide effective communication connections between printers and a variety of other devices, a stronger and more durable mechanical connection is sometimes desirable. That is, in some applications, the connection made by a cable may be subject to tension, vibration, or other stresses or movements, which can interrupt the operation of a printer cable and/or damage the cable. For example, a typical USB connector is not configured to resist tension. Therefore, if a user pulls on a printer cable, the cable may become separated from one or both of the terminals. Further, even if the cable is not disconnected, the stress on the cable can affect the operation of the conductive wires in the cable, e.g., fatiguing the cable until the cable is destroyed. For portable printers that are subjected to severe or repeated stress, these aspects of printer cables can be especially troublesome.

For example, although many portable devices, such as printers, are equipped with straps or other means for picking up and carrying the device, it is often the case that the use will pick up and some times carry the device by the printer communications cable. This handling can cause excessive wear on the printer cable and the connection, which can decrease the life expectancy of the printer cable and possibly promote connection failure.

Thus, there exists a need for an improved connection and method for communicating between the terminals of printers and other devices. The connection should provide an increased resistance to failure. Further, the connection should be compatible with connectors of various types. Such improvements are especially needed in the field of portable printers.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present invention provides an electrical connection for communicating between the electrical terminals of electrical devices. The connection can be used for communicating between various types of electrical devices, including computers, printers, mouses, keyboards, scanners, cameras, modems, network cards, other computer peripheral devices or network devices, fax machines, telephones, and the like. Each electrical device can include one or more terminal or port by which the device can be connected to other devices. The term "terminal" is not meant to be limiting, and it is appreciated that each terminal can include one or more male or female electrical connector and can generally be any of various types of connectors. In addition, each terminal can be mechanically connected, e.g., by securing a cable to the terminal with a collar, as described below to prevent disconnection of the electrical connection at the terminal.

Figure 1:
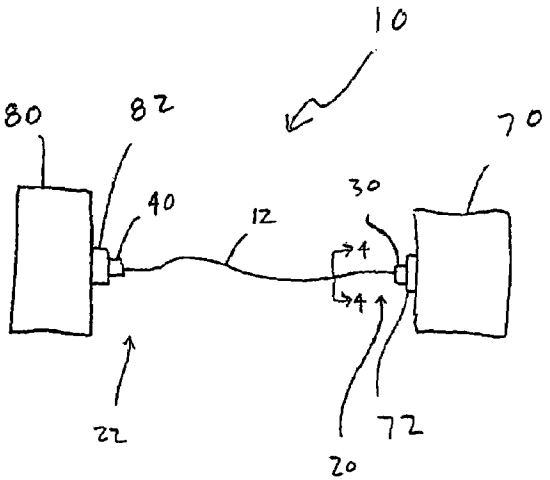
FIG. 1 is a schematic view illustrating a connection between a printer and a computer according to one embodiment of the present invention.

Referring now to the figures and, in particular, to FIG. 1, there is schematically illustrated a connection 10 according to one embodiment of the present invention. The connection 10 is formed between a first electrical device 70 and a second electrical device 80 via an electrical cable 12. As illustrated and described below, the first device 70 is a printer and the second device 80 is a computer for controlling a printing operation of the printer, though it is understood that each of the devices can be various other components.

Figure 2:
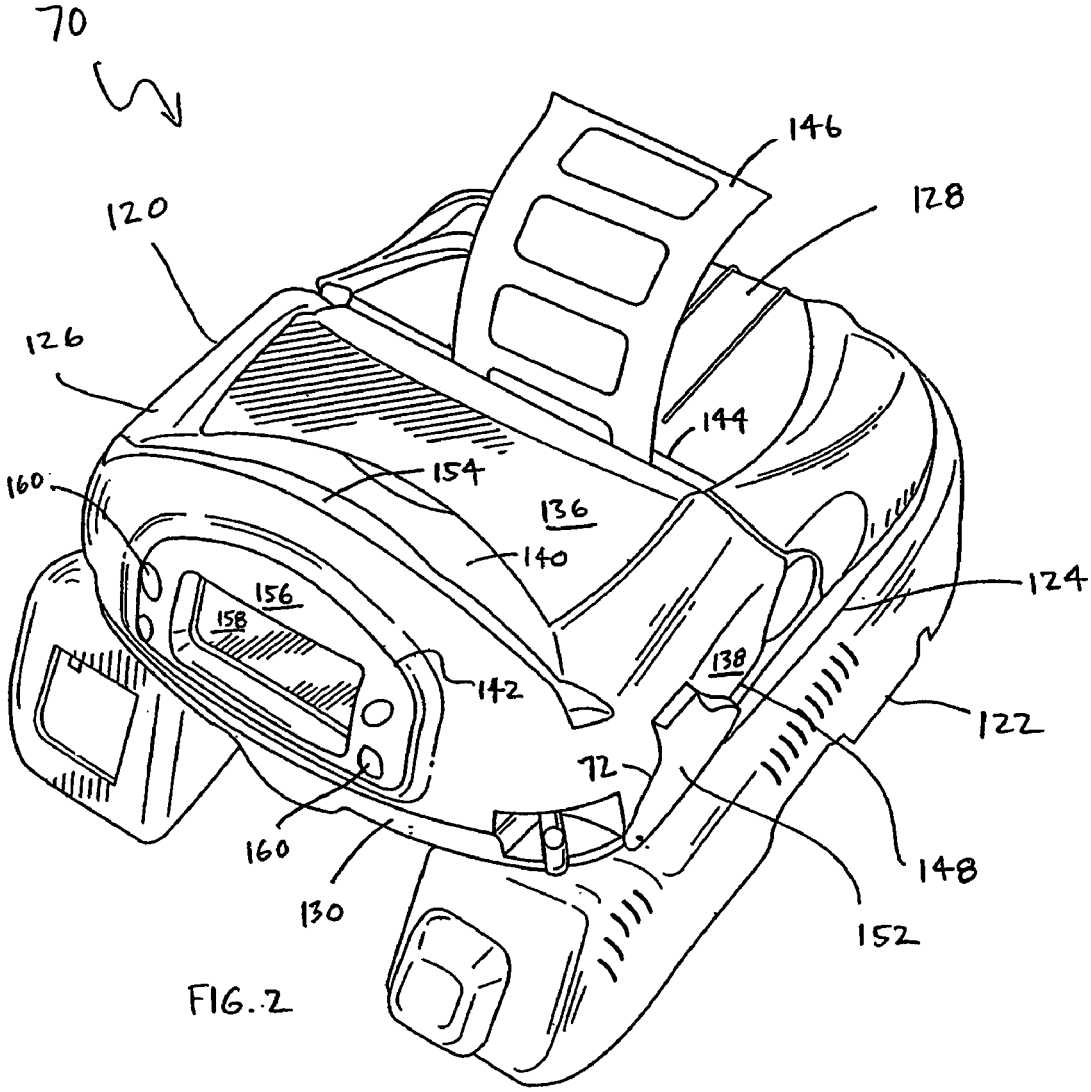
FIG. 2 is a perspective view illustrating a printer that can be connected via the connection of FIG. 1 according to one embodiment of the present invention.
Figure 3:
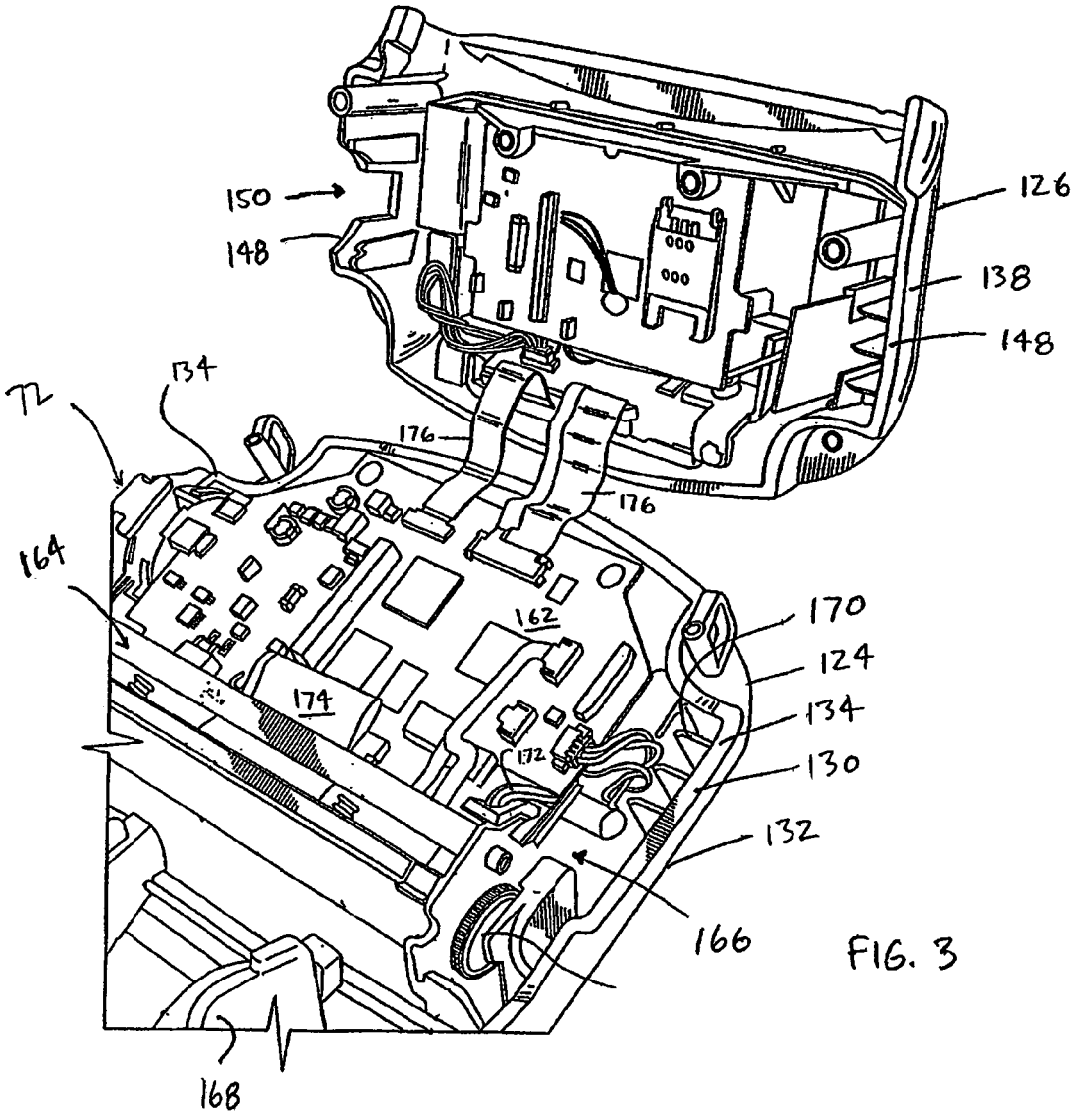
FIG. 3 is a perspective view illustrating the printer of FIG. 1 with a cover in an open configuration so that a main circuit board of the printer and a terminal connected to the circuit board can be seen.

In particular, the printer 70 can be a handheld, portable printer as shown in FIGS. 2 and 3. Generally, the printer 70 includes a rounded, rectangular body or housing 120 that can be supported within a cradle 122 or removed therefrom. The housing 120 has three main sub-portions, including a base 124, a wireless card processor cover 126, and a media supply lid or cover 128. As shown in FIG. 3, the base 124 has a rectangular shape with a wall structure 130 extending upward from a bottom surface 132 to support and contain various electronic and mechanical assemblies of the printer 70. The wall structure 130 ends in a free edge 134 that extends continuously around the rectangular shape of the base 124 and is configured to mate with the card processor cover 126 and the media supply cover 128. The wireless card processor cover 126 includes a deck portion 136, a pair of sidewalls 138, an information card receiving portion 140, and a display portion 142. The deck portion 136 is a relatively planar surface that extends between the pair of sidewalls 138 and defines one edge of a media dispensing opening 144 through which a strip of media 146 extends, as shown in FIG. 2. Each of the sidewalls 138 includes a free edge 148 that is configured to mate with the media supply cover 128 and with the free edge 134 of the base wall structure 130. The wall structure 130 of the base 124 and one of the sidewalls 138 together define an input/output (I/O) opening 150 corresponding to a terminal 72 of the printer 70 for receiving and connecting various input and output devices such as the computer 80. Covering the I/O opening is a flexible, resilient I/O cap or cover 152 that can be removed to expose the terminal 72, shown more clearly in FIG. 6.

The printer 70 can include a module portion 140, which is shown abutting the deck portion 136 in FIG. 2. The module portion 140 can be any type of communication module, such as an optical scanner, RF receiver/transmitter, RFID reader/encoder, magnetic strip reader, smart card reader, etc. In the illustrated embodiment, the module is an information card receiving portion 140 that extends upwardly to a peak and downwardly transitioning into the display portion 142. Defined at the peak of the information card receiving portion 140 is a card receiving slot 154 that is sized and shaped to allow a magnetic strip information card (such as a credit card) to be "swiped" therethrough for reading and decoding of information recorded thereon. Other types of information card could also be extended through the card receiving slot 154 for reading, including various bar-coded cards or contact and non-contact smart cards. Further, any media, such as envelope, slip of paper, etc., having a magnetic strip or smart card features could be slid and read via the slots. The display portion 142 of the card processor cover 126 defines a display opening through which extends a display unit 156, as shown in FIGS. 2 and 3. The display unit 156 includes a display screen 158 and four buttons 160 that communicate information on operation of the printer 70 and record inputs and selections by the operator. In some cases, information read using the slot 29 can be communicated via the connection 10 to the computer 80.

In this regard, the terminal 72 can be connected to a circuit board 162 housed in the printer 70 that enables the print functions of the printer 70 as well as communication to and from the computer 80, i.e., via the connection 10. Referring again to FIG. 3, the base 124 of the housing 120 supports the main circuit board 162, a print head assembly 164, a media drive assembly 166, and a media support assembly 168. The print head assembly 164, the drive assembly 166, and the media support assembly 168 are mounted on a frame 170, as shown in FIG. 3. The main circuit board 162 includes a microprocessor and other electronic components for controlling printer operations and is not described in greater detail herein for the sake of brevity. A pigtail wire 172 connects the main circuit board 162 to the drive assembly 166 and ribbon cables 174 connect the main circuit board 162 to the print head assembly 164. Ribbon cables 176 connect the display unit 156 to the main circuit board 162. These connections enable the main circuit board 162 to communicate with, and control, the print head and drive assemblies 164, 166.

Figure 4:
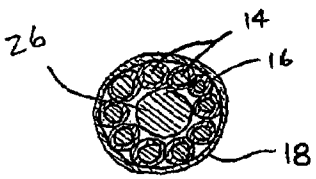
FIG. 4 is a section view illustrating the cable of the apparatus of FIG. 1 as seen along line 4—4 of FIG. 1.

As illustrated in FIG. 4, the cable 12 is typically a plurality of electrically conductive elements 14, such as copper wires, which are individually coated with a nonconductive polymer 16 and collectively housed in an outer tubular sheath 18. The cable 12 can extend from a first end 20 to a second end 22, and at least one connector 30, 40 is connected to the cable 12 at each end 20, 22. That is, as shown in FIG. 1, a first connector 30 connects the first end 20 of the cable 12 to the first terminal 72 of the printer 70, and a second connector 40 connects the opposite end 22 of the cable 12 to a second terminal 82 of the computer 80. In the illustrated embodiment, the first terminal 72 of the printer 70 is configured to communicate via multiple protocols, and various types of connectors can be provided at the second end 22 of the cable 12 as described below. Thus, the second end 22 of the cable 12 can be configured to be connected to various types of terminals of devices, and in this regard the second connector 40 can be the same as or different from the first connector 30.

Figure 5:
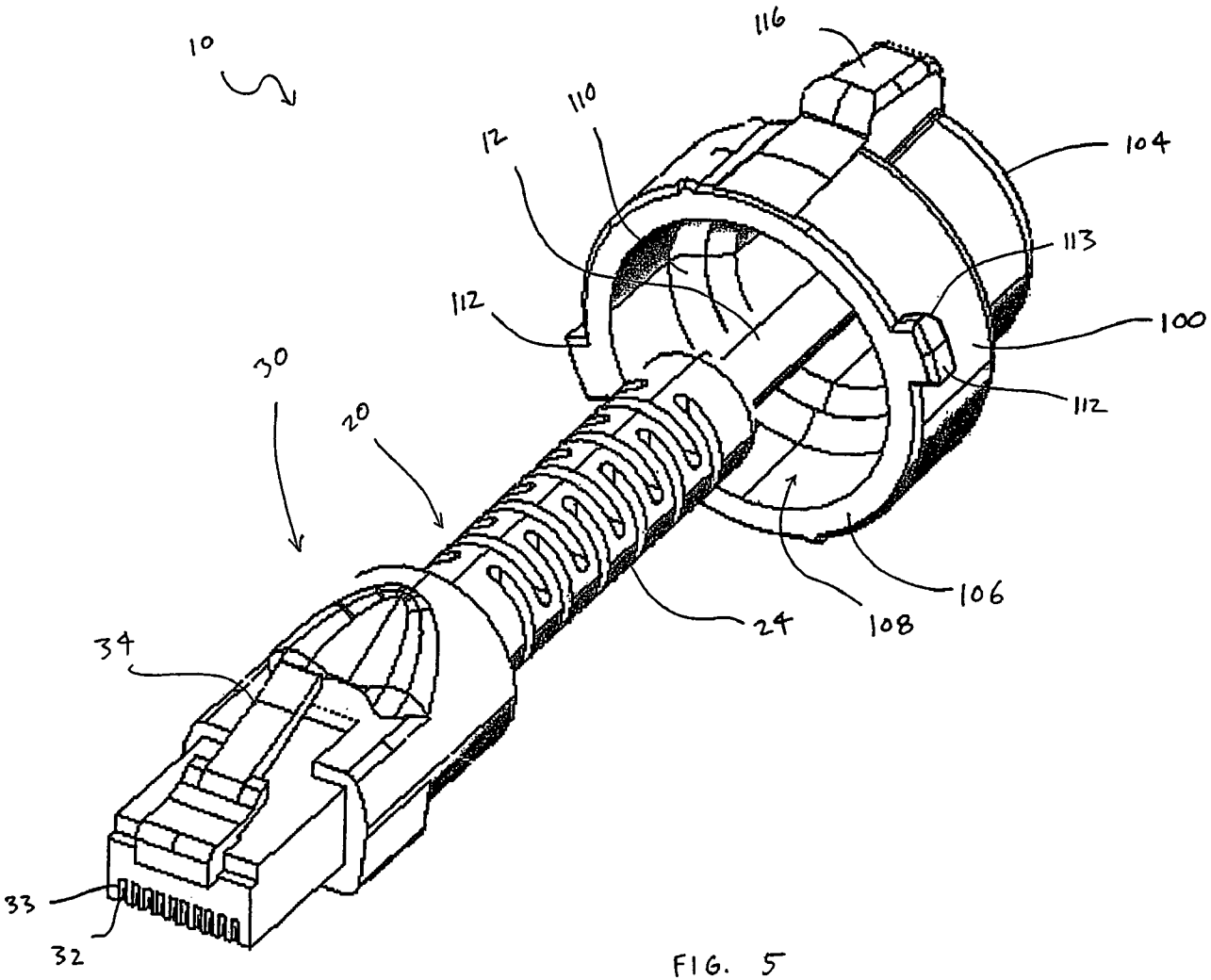
FIG. 5 is a perspective view illustrating the cable, first connector, and collar of the connection of FIG. 1.
Figure 6:
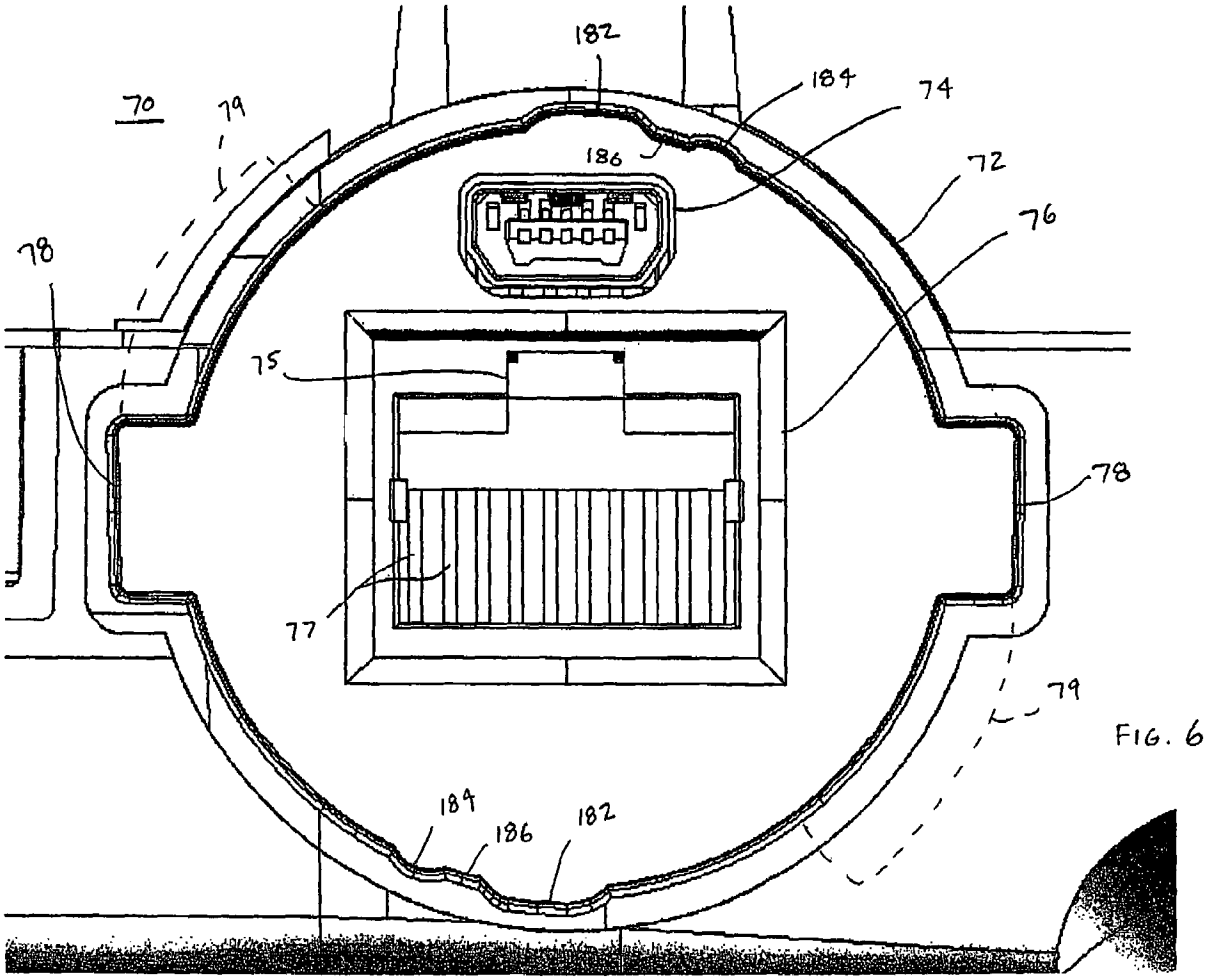
FIG. 6 is an elevation view illustrating an electrical terminal of the printer of FIG. 2 that can be connected to the connector of FIG. 5.

As illustrated in FIG. 5, the first connector 30 can be a modular connector that includes a plurality of electrical contacts 32 such as pins, which are disposed in slots 33 in the connector 30. For example, the modular connector 30 can be a RJ-45, RJ-12, or RJ-11 connector. The electrical contacts 32 of the connector 30 are connected to the conductive elements 14 of the cable 12. Thus, when the first connector 30 is connected to the first terminal 72 of the printer 70, the conductive elements 14 of the cable 12 are connected to the printer 70. In this regard, FIG. 6 illustrates the first terminal 72 of the printer 70 according to one embodiment of the present invention. As illustrated, the first terminal 72 provides a connector 76 with electrical contacts 77 that correspond to the contacts 32 of the first connector 30 on the cable 12. A slot 75 can also be defined by the terminal 72 for receiving a clip 34 on the modular connector 30 to thereby retain the connector 30 in the terminal 72.

Figure 10:
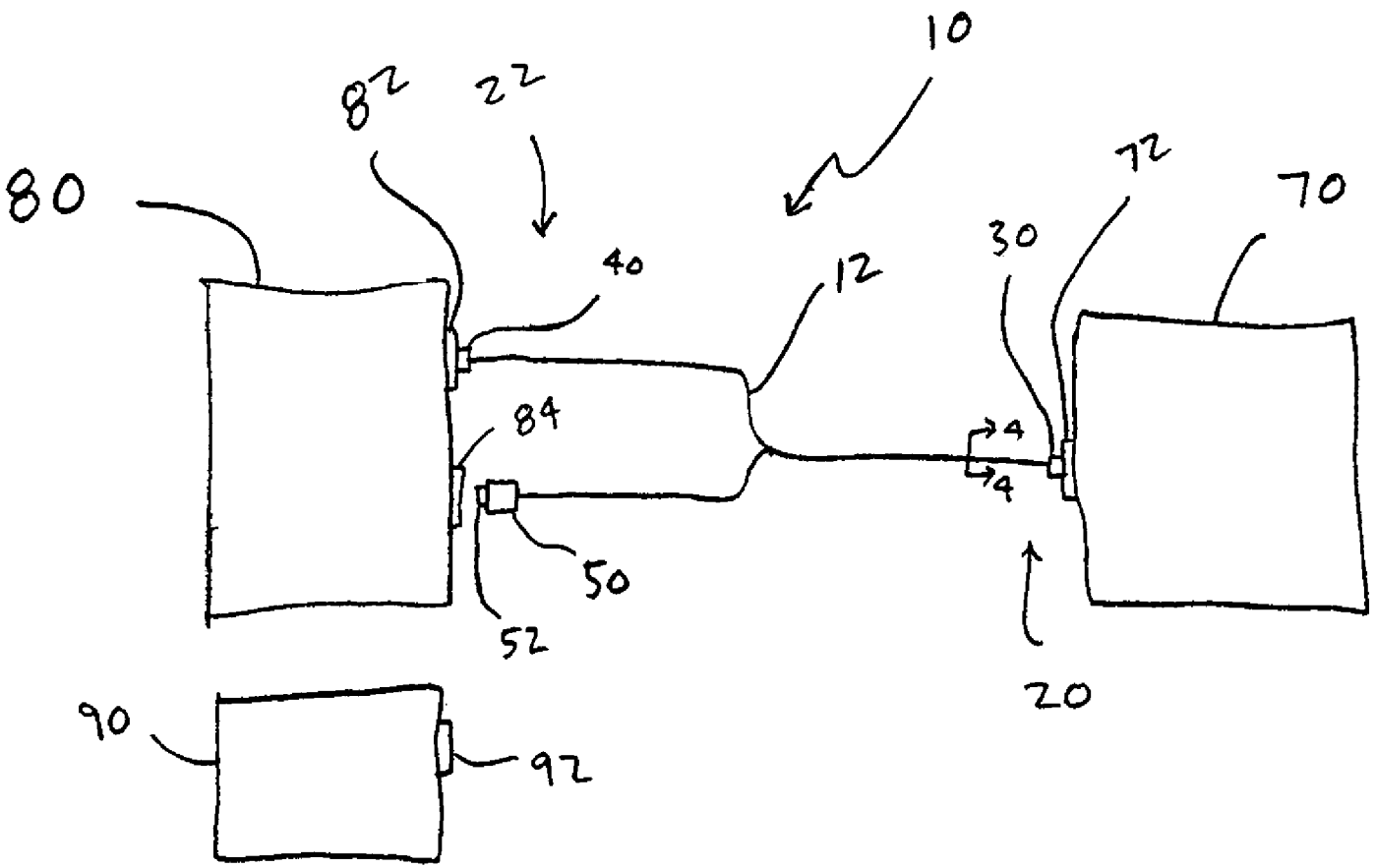
FIG. 10 is a schematic view illustrating the first and second connectors and the connection therebetween according to another embodiment of the present invention.

The first terminal 72 can be configured to communicate via different contacts 77 according to the type of communication to be performed. For example, as illustrated in FIGS. 6 and 10, the connector 76 includes ten contacts 77. In one embodiment, four of the contacts 77 (such as the two leftmost and two rightmost contacts 77) are configured for communicating using a first communication protocol, and six of the contacts 77 (such as the middle six contacts 77) are used for communicating with a second protocol. The first and second protocols can be a USB communication protocol and an RS-232 communication protocol, respectively. Thus, the first terminal 72 can be adapted to communicate using either or both of the protocols for communication with another device. In other embodiments of the present invention, the first terminal 72 can be configured for communicating with other protocols and/or with different ones of the contacts 77.

Figure 9:
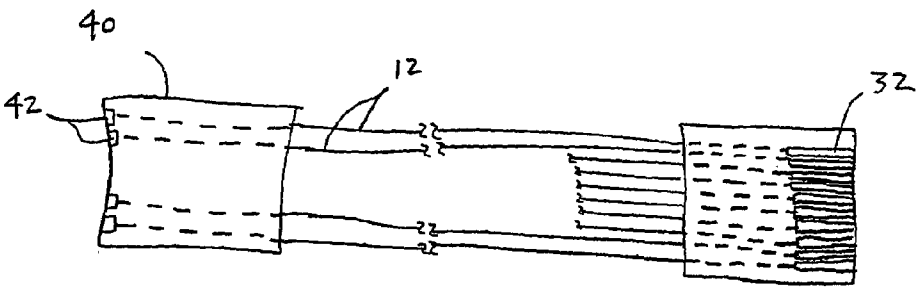
FIG. 9 is a schematic view illustrating the electrically conductive elements of an apparatus according to one embodiment of the present invention.

At the second end 22 of the cable 12, the second connector 40 can be connected to a select group of the conductive elements 14 to correspond with particular contacts 32, 77 of the first connector 30 and the first terminal 72. That is, during assembly of the cable 12 and connectors 30, 40, the second connector 40 can be connected to the conductive elements 14 that are to be used for a select one of the communication protocols. Thus, during operation, the first terminal 72 can communicate via the second connector 40 and, hence, the second terminal 82 using the select protocol. For example, as shown in FIG. 9, only 4 of the conductive elements 14 are selectively connected to contacts 42 of the second connector 40 for connection to the second terminal 82. The first connector 30, however, can be connected to all of the contacts 77 of the first terminal 72 such that the first connector 30 can be used with either communication protocol. Thus, the first connector 30 and the cable 12 can be manufactured and then assembled with any of various types of second connectors 40 and with the second connector 40 configured for communication with any of the conductive elements 14 and hence any protocol supported by the first terminal 72. That is, the contacts 42 of the second connector 40 can be selectively connected to any of the conductive elements 12.

In some cases, a third connector 50 can be provided on the cable 12 such that the printer 70 can communicate selectively via either or both of the second and third connectors 40, 50. For example, as schematically illustrated in FIG. 10 the first connector 30 can be connected to the printer 70, and the second and third connectors 40, 50 can be selectively connected to either the computer 80 or to a third terminal 92 of another electrical device 90. Alternatively, both of the second and third connectors 40, 50 can be simultaneously connected, i.e., both to the computer 80 or one to the computer 80 and the other to the third device 90. In either case, either of the second and third connector 40, 50 can be connected to the respective devices 80, 90 depending on the type of terminal(s) provided by those devices 80, 90. For example, if the computer 80 has a terminal 82 that corresponds to the second connector 40, the second connector 40 can be connected thereto. Otherwise, if the terminal 82 of the computer 80 corresponds to the third connector 52, the third connector 50 can be connected thereto.

Each of the second and third connectors 40, 50 can be electrically connected to the first connector 30 via any of the conductive elements 14 of the cable 12, so that the printer 70 can communicate with the other device(s) 80, 90 via either connector 40, 50 and using either protocol. For example, both of the second and third connectors 40, 50 can be USB connectors and can be connected by the same conductive elements 14 to the contacts 77 of the first terminal configured for the USB protocol. Alternatively, the second connector 40 can be a USB connector that is connected by a first group of the conductive elements 14 to the contacts 77 of the first terminal 72 configured for the USB protocol, and the third connector 50 can be a non-USB connector that is connected by a second group of the conductive elements 14 to the contacts 77 of the first terminal 72 that are configured to communication with a non-USB protocol. For example, the third connector 50 can be an RS-232 compliant connector such as an RJ-45 connector, a DB25 connector, or a DB9 connector.

In this way, separate paths of communication between the first connector 30 and the second and third connectors 30, 50 can be provided. Thus, the printer 70 can communicate separately via the cable 12 to one or more devices 80, 90 at the same time or at different times. In any case, the cable apparatus 10 can provide multiple possible configurations for connecting the printer 70 to one or more other devices 80, 90. Thus, a user can connect the printer 70 to different types of other devices, even if the other devices have different types of connectors or if multiple connections to one or more devices are required. It is also appreciated that any number of conductive elements 14 can be provided, any number of which can be used for any particular communication protocol.

In one embodiment of the present invention, the printer 70 can include an encoder/decoder device for communicating using each of the communication protocols. For example, the printer 70 can include first and second encoder/decoder devices, which can be part of the main circuit board 162 or otherwise included in the printer 70. The first encoder/decoder device can be configured to communicate via a first plurality of the conductive elements 14 of the cable 12 using a first communication protocol, and the second encoder/decoder device can be configured to communicate via a second plurality of the conductive elements 14 using a second communication protocol. Each of the encoder/decoder devices can communicate with a processor of the printer 70, such as a microprocessor of the main circuit board 162. Thus, if a signal is received via the first plurality of conductive elements 14 of the cable 12, the signal is routed to the first encoder/decoder device, whereupon the first encoder/decoder device communicates the signal to the processor. If a signal is received via the second plurality of conductive elements 14, the signal is routed to the second encoder/decoder device, whereupon the second encoder/decoder device communicates the signal to the processor. Similarly, the printer 70 can selectively communicate using the two protocols. For example, the processor can transmit a signal via the first encoder/decoder device to the first plurality of conductive elements 14 of the cable 12 using the first communication protocol, or the processor can transmit a signal via the second encoder/decoder device to the second plurality of conductive elements 14 of the cable 12 using the second protocol. In some cases, the printer 70 can communicate using both protocols, or the printer 70 can automatically select one of the communication protocols. For example, if the printer 70 receives a signal via the cable 12, the printer 70 can thereafter communicate using the same protocol.

Referring again to in FIG. 6, it is shown that the first terminal 72 (shown with the cover 152 removed) can include more than one electrical connector for engaging the cable 12. For example, the first terminal 72 can include a conventional USB connector 74 or various other types of connectors. In this regard, the first terminal 72 can be configured to be selectively connected to different types of connectors or connected to multiple connectors at one time. In some cases, the USB connector 74 can provide the same communication from the printer 70 as that provided via some of the contacts 77. Thus, the printer 70 can be selectively connected to another device via either of the connectors 74, 76. For example, if the device 70 is a printer as described above, a user can connect the printer to a computer, network device, or the like via either the USB connector 74 or the modular connector 76, e.g., depending on the type of connection cable that is available to the user, the type of terminal(s) on the computer or other device, and the like.

As shown in FIGS. 5–8, a collar 100 can be provided at one or more of the ends 20, 22 of the cable 12 for mechanically engaging a respective one of the terminals 72, 82, 84, 92 and thereby securing one of the connectors 30, 40, 50 to the respective terminal. The illustrated collar 100 generally includes a body extending axially from a first side 104 to a second side 106. An orifice 108 extends in the axial direction through the collar 100 for receiving the cable 12 and/or at least part of one of the connectors 30, 40, 50. For example, at the first side 104 the orifice 108 can be slightly larger than the cross-sectional size of the cable 12, and the orifice 108 can be relatively larger at the second side 108 so that a portion of the connector 30 can be received in the orifice 108 and secured against a shoulder 110 defined in the orifice 108 between the dissimilarly sized portions of the orifice 108. Thus, with the cable 12 extending through the orifice 108, the collar 100 can be slidably adjusted along the length of the cable 12 toward the connector 30 so that the shoulder 110 is disposed against the connector 30. That is, with the collar 100 connected to the terminal 72 as described below, the collar 100 can improve the ruggedness of the connection between the cable 12 and the terminal 72.

In some cases, the cable 12 can include a flexible support portion 24 that is stronger and typically stiffer than the rest of the cable 12 and resists fatigue or other wear that might otherwise occur at the interface of the cable 12 and the connector 30, and the orifice 108 at the first side 104 of the collar 100 can be sized to receive the flexible support portion 24. The flexible support portion 24 typically has a cross-sectional size that is larger than the rest of the cable 12, i.e., the portion of the cable 12 that is disposed opposite the support portion 24 from the first connector 30. In one embodiment of the present invention, the orifice 108 has a size that corresponds with the size of the flexible support portion 24 so that the flexible support portion 24 is frictionally engaged in orifice 108 as the collar 100 is slid toward the first connector 30 and the first terminal 72. Thus, the collar 100 can further support the cable 100, thereby resulting in a rugged connection between the cable 12, connector 30, and terminal 72.

Figure 7:
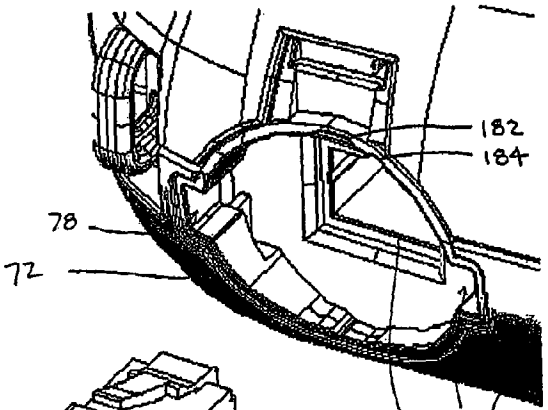
FIG. 7 is a perspective view illustrating the apparatus of FIG. 5 and the terminal of FIG. 6 before the cable is connected to the terminal.
Figure 7:
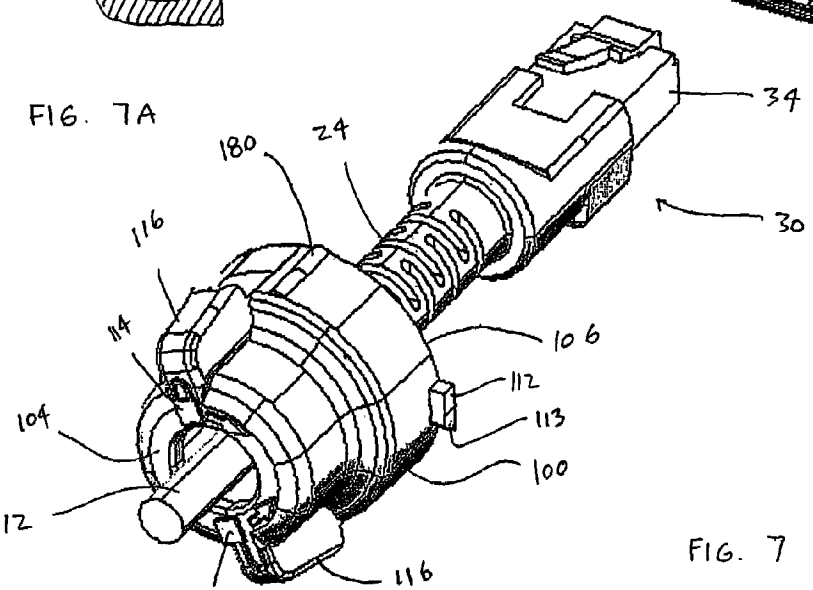
Figure 8:
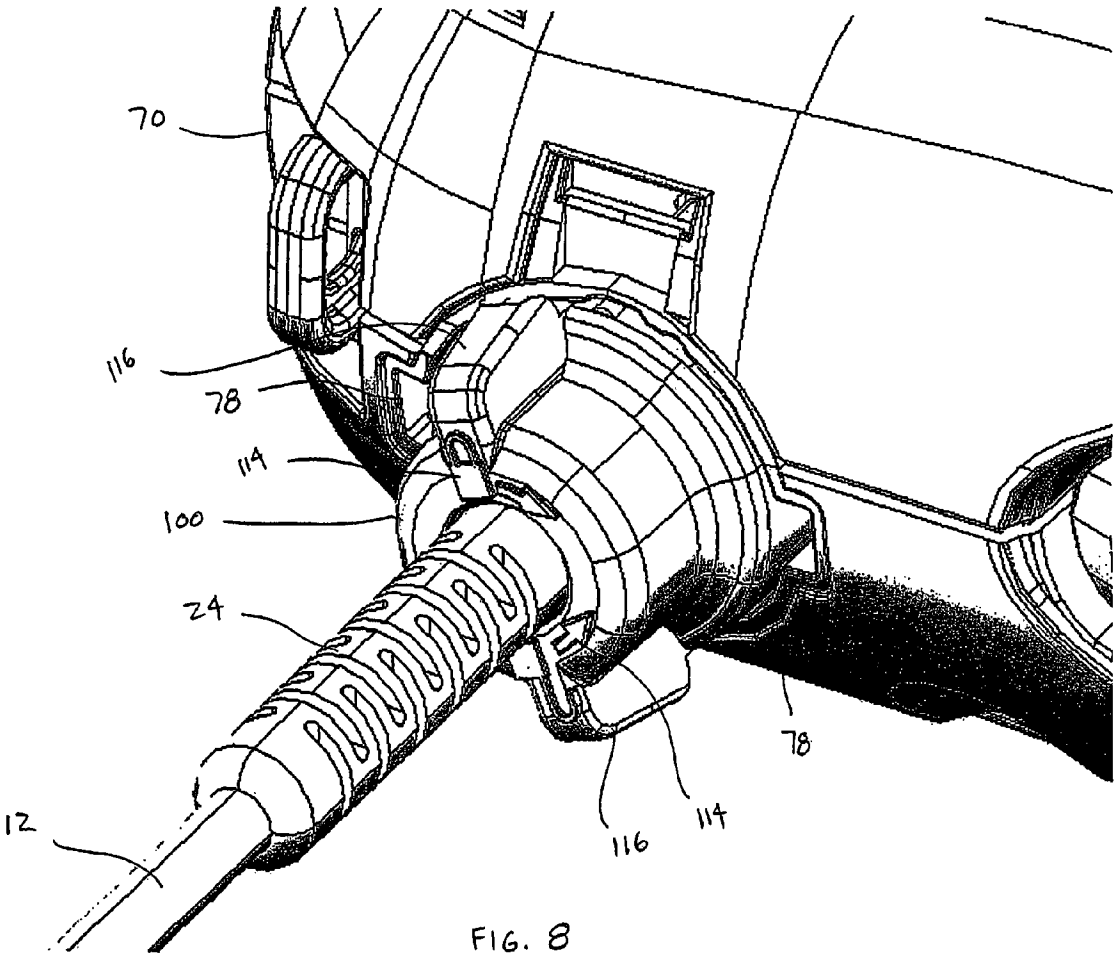
FIG. 8 is a perspective view illustrating the apparatus of FIG. 5 connected to the terminal of FIG. 6.

The collar 100 also defines a connection feature that is configured to be mechanically engaged to the first terminal 72. Various types of connection features can be defined by the collar 100, included threads, cams, clips, snap rings, magnets and the like. As illustrated in FIG. 7, the collar 100 defines tabs 112 that extend radially outward from the body of the collar 100, and the first terminal 72 is configured to receive and engage the tabs 112. In particular, the first terminal 72 defines slots 78 corresponding in position to the tabs 112 of the collar 100 and extending in the axial direction so that the collar 100 can be advanced toward the terminal 72 with the tabs 112 being disposed in the slots 78. A channel 79 (FIG. 6) extending circumferentially from each slot 78 is configured to receive and retain the tabs 112 as the collar 100 is rotated. That is, the tabs 112 can be advanced through the slots 78, then rotated (clockwise, as shown in FIGS. 7 and 8) into the channels 79 so that the collar 100 is engaged by the terminal 72 and retained to prevent removal of the collar 100 until the collar 100 is rotated in the opposite direction (counterclockwise, as shown in FIGS. 7 and 8) to again align the tabs 112 in the slots 78. Each tab 112 can define a chamfered or ramped edge 113 to facilitate the entry of the tabs 112 into the channels 79 and configured so that the collar 100 is pulled against the terminal 72 as the tabs 112 are engaged thereto. Indicia 114 such as text or graphic illustrations can be provided on the collar 100 or the printer 70 to indicate how to engage and disengage (i.e., lock and unlock) the collar 100 to and from the terminal 72. In addition, the collar 100 can define a grip portion, such as radially extending flanges 116 or otherwise contoured surface to facilitate gripping of the collar 100 by the user.

The collar 100 and first terminal 72 can also be configured to lock in the engaged position. That is, once the collar 100 is rotated to an engaged position, the collar 100 and terminal 72 can resist counter-rotation for disengaging the collar 100. Various types of locking features can be provided in this regard. In particular, as illustrated in FIGS. 6 and 7, the collar 100 defines a rib 180 or key member that extends radially outward therefrom. The terminal 72 defines two slots 182, 184, i.e., detents or keyways, for receiving the rib 180. The first slot 182 is configured to receive the rib 180 as the collar 100 is adjusted axially toward the terminal 72. The first slot 182 can extend in a circumferential direction so that the collar 100 can be rotated with the rib 180 in the first slot 182. When the collar 100 is sufficiently rotated clockwise, the rib 180 reaches the end of the first slot 182, passes an interference portion 186 between the slots 182, 184 that extends radially inward, and the rib 180 is then disposed in the second slot 184. With the rib 180 disposed in the second slot 184, the interference portion 186 resists the counterclockwise rotation of the collar 100. That is, with the collar 100 locked to the terminal 72, a greater torque is required to rotate the rib 180 past the interference portion 186 than is otherwise required for rotating the collar 100 with the rib 180 disposed in the first slot 182. In some cases, multiple ribs 180 can be provided with corresponding slots 182, 184.

Figure 7A:
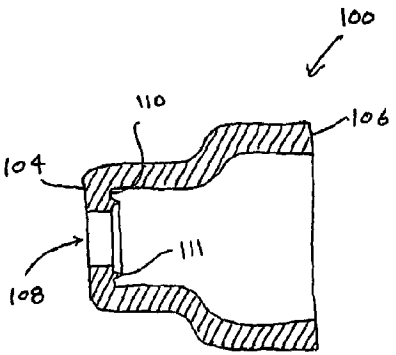
FIG. 7A is a section view illustrating the collar of FIG. 5.

The first end 20 of the cable 12 is typically connected to the first terminal 72 by first electrically engaging the contact 32 of the first connector 30 with the contacts 77 of the first terminal 72. Of course, a cable with a USB connector can similarly be selectively engaged to the USB connector 74 of the first terminal 72. In either case, the collar 100 can then be slid on the cable 12 toward the first terminal 72 and connected thereto, e.g., by advancing the tabs 112 into the slots 78 and rotating the tabs 112 into the channels 79 as described above. With the collar 100 so engaged to the first terminal 72, the collar 100 prevents the first connector 30 from being removed from the terminal 72. Thus, the collar 100 provides a secure connection between the first connector 30 and the printer 70. Further, the collar 100 can prevent the application of stress to the connection of the first connector 30 and first terminal 72. That is, if the cable 12 is put in tension, e.g., because the printer 70 is moved in a direction away from the cable 12 or the cable 12 is otherwise pulled in a direction away from the first terminal 72, the tensile force can be applied via the collar 100 to the printer 70. That is, the shoulder 110 in the collar 100 can be disposed against the first connector 30 so that, even if the cable 12 is pulled, no significant force is applied at the contacts 32, 77. In this way, a ruggedized connection between the cable 12 and the printer 70 can be created. In some cases, a raised contact area can be defined by the shoulder 110. For example, as illustrated in FIG. 7A, a circumferentially extending edge 111 can extend from the shoulder 110 such that the edge 111 is disposed against the connector 30 when the collar 100 is engaged to the terminal 72. The edge 111 can be configured to interfere with the connector 30, i.e., the edge 111 can be compressed against the connector 30, when engaged, thereby securing the connector 30 to the terminal 72 and possibly sealing the connection.

Further, it is appreciated that the cable 12 can be reinforced to provide greater resistance to breakage, wear, or other damage and thereby further increase the rugged nature of the connection. In particular, if conductive elements 14 are separately provided in the cable 12 for separately communicating using either of two protocols via either of two groups of the contacts 32 of the first connector 30, the combination of the conductive elements 14 can provide increased strength as compared to the conductive elements 14 used for a single one of the communication protocols. In other words, if the connector 76 of the first terminal 72 is configured to communicate using both USB and RS-232 protocols, and a sufficient number of conductive elements 14 is provided for separately communicating by the two protocols, the number of conductive elements 14 can be greater and, hence provide increased strength, as compared to the conductive elements 14 for only the USB communication. Thus, the combination of the conductive elements 14 for the multiple communication protocols in a single cable and connector can provide an increase is strength over conventional cables and connectors for either of the single communication protocols.

In addition, the cable 12 can include various other types of reinforcement. For example, as shown in FIG. 6, a reinforcement member 26 can be disposed in the sheath 18 of the cable 12 to provide additional support to the cable 12. The reinforcement member 26 can extend along part or all of the cable 12, and can extend into one or more of the connectors 30, 40, 50. For example, the reinforcement member 26 can extend from the first connector 30 approximately coterminous with the flexible support portion 24. Alternatively, the reinforcement member 26 can extend from the first connector 30 to the second connector 40 at the opposite end 22 of the cable 12, and the third connector 50, if present. In any case, the reinforcement member 26 can be formed of various materials and can have various configurations. For example, the reinforcement member 26 can be a single elongate rod-like member as shown in FIG. 6. Typically, the reinforcement member 26 is rigid and thereby prevents excessive flexing of the cable 12 adjacent the connector 30. For example, the reinforcement member 26 can have a stiffness that is greater than the stiffness of the combination of the conductive elements 14 and/or the sheath 18 of the cable 12 and, in some cases, can have a stiffness that is more than two, three, four, or five times the stiffness of the conductive elements 14 and/or the sheath 18, or otherwise stiffer than the conductive elements 14 and/or the sheath 18.

While the reinforcement member 26 is described above as a single rod-like member, the reinforcement member 26 alternatively can be a plurality of smaller, fiber-like members disposed among the conductive elements 14 in the cable 12 or a sheet of material that is wrapped around the conductive elements 14 within the sheath 18. In any case, the reinforcement member 26 can be formed of an electrically nonconductive material such as various polymers, paper, cardboard, or the like. Alternatively, the reinforcement member 26 can be formed of a conductive material such as metal. In some cases, a conductive reinforcement material can be used as one of the conductive members 14 for communicating along the cable 12.

The collar 100 can be used to engage various types of connectors. For example, in addition to engaging the first connector 30 to the first terminal 72, a collar can be provided for engaging each of the second and/or third connectors 40, 50 to one of the respective terminals 82, 84, 92. When used with a cable having connectors at opposite ends, as illustrated in FIG. 1, the collar 100 can be disposed on the cable 12 before at least one of the connectors 30, 40 is attached to the cable 12 so that the collar 100 is slidably retained on the cable 12 by the connectors 30, 40 at the opposite ends 20, 22. That is, to provide the collar 100 on the cable 10 of FIG. 1, the second connector 40 could first be connected to the cable 12, the first end 20 of the cable 12 could be inserted through the orifice 108 of the collar 100, and the first connector 30 could then be connected to the first end 20 of the cable 12.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A connection system for electrically engaging an electrical cable with an electrical connector to a terminal of a printer, the connection system comprising:

an electrical terminal having a plurality of electrical contacts, the electrical terminal being configured to communicate via the plurality of the electrical contacts using a communication protocol;

an electrical connector including a plurality of electrical contacts corresponding to the electrical contacts of the electrical terminal such that the electrical connector can be engaged to the electrical terminal;

an electrical cable including a plurality of conductive elements for electrical communication, the conductive elements being electrically connected to the electrical contacts of the electrical connector such that the plurality of conductive elements is electrically connected to the plurality of electrical contacts of the terminal, the electrical cable including a flexible support portion adjacent the electrical connector, the flexible support portion defining a cross-sectional size that is larger than a portion of the cable opposite the flexible support portion from the connector, wherein the electrical cable includes a tubular sheath, the conductive elements being disposed in the sheath, and a reinforcement member disposed in the sheath proximate to the connector and configured to support the cable proximate to the connector; and a collar extending in an axial direction from a first end to a second end and defining an orifice between the first and second ends, at least a portion of the orifice corresponding in size to the cross-sectional size of the flexible support portion and being smaller than a cross-sectional size of the electrical connector such that the collar is adapted for slidably receiving the cable and frictionally engaging the flexible support portion of the cable, wherein the collar defines a connection feature configured to engage the terminal with the cable extending through the orifice and the electrical connector disposed at least partially between the collar and the terminal such that the engagement of the collar with the terminal prevents disconnection of the electrical connector from the terminal.

2. A connection system according to claim 1 wherein the connection feature of the collar is configured to be advanced in the axial direction of the collar toward the terminal and rotated relative to the terminal to thereby engage the connection feature with the terminal.

3. A connection system according to claim 1 wherein the connection feature includes two tabs extending radially outward, each tab being configured to be received axially through a slot in the terminal with the collar in a first position and rotated into a channel as the collar is rotated to a second position such that the tabs prevent the collar from being removed form the terminal in the second position.

4. A connection system according to claim 1 wherein a radially outer surface of the collar defines a grip portion.

5. A connection system according to claim 1 wherein the collar defines a rib extending radially outward and configured to be received in a slot defined by the terminal such that the rib can be engaged in the slot.

6. A connection system according to claim 1 wherein the orifice of the collar defines a first portion proximate to the first end of the collar and a second portion proximate to the second end of the collar, the first portion of the orifice having a smaller cross-sectional size than the second portion of the orifice, the collar defying a shoulder between the first and second portions of the orifice, the shoulder being configured to be disposed against the electrical connector when the electrical connector and the collar are engaged to the terminal, such that the shoulder prevents disengagement of the connector from the terminal.

7. A connection system for communicating between an electrical device and a portable printer comprising a print head assembly, a media drive assembly, and a media support assembly, the connection system comprising:

the printer defining a first electrical terminal having a plurality of electrical contacts, the first electrical terminal being configured to communicate via the plurality of the electrical contacts using at least one communication protocol;

the electrical device defining a second electrical terminal having a plurality of electrical contacts, the second electrical terminal being configured to communicate via the plurality of the electrical contacts using the communication protocol; and an electrical cable apparatus electrically connecting the first and second terminals, the electrical cable apparatus comprising:

an electrical cable extending between first and second ends, the electrical cable including a plurality of conductive elements for electrical communication;

a first electrical connector connected to the cable at the first end of the cable, the first electrical connector defining a plurality of electrical contacts corresponding to the electrical contacts of the first electrical terminal such that the first electrical connector can be engaged to the first electrical terminal;

a second electrical connector connected to the cable at the second end of the cable, the second electrical connector defining a plurality of electrical contacts corresponding to the electrical contacts of the second electrical terminal such that the second electrical connector can be engaged to the second electrical terminal; and a collar extending in an axial direction from a first end to a second end and defining an orifice between the first and second ends with the cable disposed through the orifice and the orifice corresponding in size to a cross-sectional size of at least a portion of the cable adjacent the first electrical connector and being smaller than a cross-sectional size of the first electrical connector such that the collar is slidably mounted on the cable and adapted to frictionally engage the cable adjacent the first electrical connector, wherein the collar defines a connection feature configured to engage the first terminal with the first electrical connector disposed at least partially between the collar and the first terminal such that the engagement of the collar with the first terminal prevents disconnection of the first electrical connector from the first terminal, and wherein the electrical cable includes a tubular sheath the conductive elements disposed in the sheath, and a reinforcement member disposed in the sheath proximate to the first electrical connector and configured to support the cable proximate to the connector.

8. A connection system according to claim 7 wherein the electrical cable defines a flexible support portion adjacent the first electrical connector, the flexible support portion having a cross-sectional size that is larger than a portion of the cable opposite the flexible support portion from the connector, and wherein at least a portion of the orifice corresponds in size to the cross-sectional size of the flexible support portion such that the collar is adapted for sliding along the cable and frictionally engaging the flexible support portion of the cable.

9. A connection system according to claim 7 wherein the connection feature of the collar is configured to be advanced in the axial direction of the collar and thereby slid along the cable toward the first terminal and rotated relative to the first terminal to thereby engage the connection feature with the first terminal.

10. A connection system according to claim 7 wherein the connection feature includes two tabs extending radially outward, and the first terminal, defines slots and channels corresponding to the tabs such that each tab is configured to be received axially through one of the slots with the collar in a first position and rotated into one of the channels as the collar is rotated to a second position such that the tabs prevent the collar from being removed from the first terminal in the second position.

11. A connection system according to claim 7 wherein a radially outer surface of the collar defines a grip portion.

12. A connection system according to claim 7 wherein the collar defines a rib extending radially outward and the terminal defines at least one slot for receiving the rib and interferingly engaging the rib.

13. A connection system according to claim 7 wherein the orifice of the collar defines a first portion proximate to the first end of the collar and a second portion proximate to the second end of the collar, the first portion of the orifice having a smaller cross-sectional size than the second portion of the orifice, the collar defining a shoulder between the first and second portions of the orifice, the shoulder being configured to be disposed against the first electrical connector when the first electrical connector and the collar are engaged to the first terminal, such that the shoulder prevents disengagement of the first connector from the first terminal.

14. A collar for reinforcing the connection of an electrical cable with an electrical connector to a terminal of a printer, the collar comprising:

a body extending in an axial direction from a first end to a second end and defining an orifice between the first and second ends, at least a portion of the orifice correspond in size to a cross-sectional size of the cable adjacent the electrical connector and being smaller a cross-sectional size of the electrical connector such that the body is adapted for slidably receiving the cable, frictionally engaging the cable adjacent the electrical connector, and engaging the electrical connector;

a connection feature configured to engage the terminal with the cable extending through the orifice and the electrical connector disposed at least partially between the body and the terminal such that the engagement of the collar with the terminal prevents disconnection of the electrical connector from the terminal; and an electrical cable connected to the electrical connector the electrical cable including a tubular sheath, conductive elements disposed in the sheath, and a reinforcement member disposed in the sheath proximate to the electrical connector and configured to support the cable proximate to the electrical connector.

15. A collar according to claim 14 wherein the connection feature is configured to be advanced in the axial direction of the collar toward the terminal and rotated relative to the terminal to thereby engage the connection feature with the terminal.

16. A collar according to claim 14 wherein the connection feature includes two tabs extending radially outward from the body, each tab being configured to be received axially through a slot in the terminal with the collar in a first position and rotated into a channel as the collar is rotated to a second position such that the tabs prevent the body from being removed from the terminal in the second position.

17. A collar according to claim 14 wherein the body of the collar defines a grip portion on a radially outer surface of the body.

18. A collar according to claim 14 wherein the orifice of the body defines a first portion proximate to the first end of the body and a second portion proximate to the second end of the body, the first portion of the orifice having a smaller cross-sectional size than the second portion of the orifice, the body defining a shoulder between the first and second portions of the orifice, the shoulder being configured to be disposed against the first electrical connector when the first and second electrical connectors are engaged and the collar is engaged to the terminal, such that the shoulder prevents disengagement of the connector from the terminal.

19. A collar according to claim 14 wherein the body of the collar defines a rib extending radially outward and configured to be received in a slot defined by the terminal such that the rib can be engaged in the slot.

20. A method for connecting an electrical cable with a first electrical connector to a terminal of a printer, the method comprising:

providing the electrical cable connected to the connector, the cable having a tubular sheath, at least one electrical conductor disposed in the sheath, and a reinforcement member disposed in the sheath proximate to the connector and configured to support the cable proximate to the connector the reinforcement member extending partially along the cable to thereby define an end in the sheath between the ends of the cable;

disposing the electrical cable through an orifice defined by a collar;

advancing the connector toward the terminal of the printer in an axial direction and thereby electrically engaging the connector with the terminal of the printer;

advancing a first end of the collar toward the connector and the terminal and thereby frictionally engaging the collar with a portion of the cable adjacent the connector; and engaging a connection feature of the collar to the terminal of the printer with the connector disposed at least partially between the collar and the terminal, and the collar disposed against the connector such that the engagement of the collar with the terminal prevents disengagement of the electrical connector from the terminal.

21. A method according to claim 20 wherein said step of engaging the connection feature comprises advancing the connection feature of the collar iii an axial direction of the collar toward the terminal and rotating the connection feature relative to the terminal to thereby engage the connection feature with the terminal.

22. A method according to claim 20 wherein said step of engaging the connection feature comprises receiving at least a portion of the connector in the orifice of the collar such that a shoulder of the collar is disposed against a surface of the connector.

23. A method according to claim 20 further comprising connecting at least one electrical connector to an end of the cable opposite the first connector after said disposing step, wherein the orifice of the collar is smaller than the connectors at the opposite ends thereof such that the collar is retained on the cable between the ends of the cable.

24. An electrical connection for communicating between first and second electrical terminals, comprising:

a first electrical terminal capable of communicating data in at least two different select protocols, said first terminal having first and second pluralities of electrical contacts, the first electrical terminal being configured to communicate via the first plurality of the electrical contacts using a USB protocol, and the first electrical terminal being configured to communicate via the second plurality of the electrical contacts using a protocol other than a USB protocol;

a first electrical connector being a modular connector and including a plurality of electrical contacts corresponding to the electrical contacts of the first electrical terminal such that the first electrical connector can be engaged to the first electrical terminal;

an electrical cable extending from a first end to a second end, the electrical cable including first and second pluralities of conductive elements for electrical communication between the first and second ends, the conductive elements being electrically connected to the electrical contacts of the first electrical connector at the first end of the cable such that the first plurality of conductive elements is electrically connected to the first plurality of electrical contacts of the first terminal and the second plurality of conductive elements is electrically connected to the second plurality of electrical contacts of the first terminal; and a second electrical connector connected to the second end of the cable, the second connector including a plurality of electrical contacts corresponding to the electrical contacts of the second electrical terminal, the electrical contacts being selectively electrically connected to a single one of the first and second pluralities of the conductive elements of the cable such that the first terminal is configured to communicate via the second electrical connector using a select one of the protocols of the first terminal.

25. A connection according to claim 24 wherein the second electrical connector is a USB connector connected to the first plurality of conductive elements of the cable.

26. A connection according to claim 24 wherein each of the first terminal and the first connector is at least one of the group consisting of RJ-45, RJ-12, and RJ-11 connectors.

27. A connection according to claim 24 wherein the first electrical terminal is configured to communicate via the second plurality of electrical contacts using the RS-232 protocol.

28. A connection according to claim 24 wherein the electrical cable includes a nonconductive tubular sheath in which the conductive elements are disposed, and a reinforcement member disposed in the sheath proximate to the first connector, the reinforcement member extending partially along the cable to thereby define an end in the sheath between the ends of the cable.

29. A connection according to claim 24 wherein the first terminal is a printer port.

30. A connection according to claim 24, further comprising:

a collar extending in an axial direction from a first end to a second end and defining an orifice between the first and second ends, at least a portion of the orifice being larger than a cross-sectional size of the cable and smaller than a cross-sectional size of the first connector such that the collar is adapted for slidably receiving the cable and engaging the first connector, wherein the collar defines a connection feature configured to engage the first terminal with the cable extending through the orifice and the first connector disposed at least partially between the collar and the first terminal such that the engagement of the collar with the first terminal prevents disconnection of the first connector from the first terminal.

31. A connection according to claim 30 wherein the connection feature is configured to be advanced in the axial direction of the collar toward the first terminal and rotated relative to the first terminal to thereby engage the connection feature with the first terminal.

32. A connection according to claim 30 wherein the connection feature includes at least two tabs extending radially outward from the collar and configured to be received through a slot in the first terminal with the collar in a first position and rotated into a channel as the collar is rotated to a second position such that the tabs prevent the collar in the second position from being removed from the first terminal.

33. A connection according to claim 30 wherein the orifice through the collar defines a first portion proximate to the first end of the collar and a second portion proximate to the second end of the collar, the first portion of the orifice having a smaller cross-sectional size than the second portion of the orifice, the collar defining a shoulder between the first and second portions of the orifice, the shoulder being configured to be disposed against the first connector when the first connector and the collar are engaged to the terminal such that the shoulder prevents disengagement of the first connector from the first terminal.

34. A connection according to claim 30 wherein the collar defines a rib extending radially outward and configured to be received in a slot defined by the terminal such that the rib can bc engaged in the slot.

35. A method for connecting an electrical cable with a first electrical connector to a terminal of a printer, the method comprising:

providing an electrical cable connected to a connector, the cable having a tubular sheath, at least one electrical conductor disposed in the sheath, and a reinforcement member disposed in the sheath proximate to the connector and configured to support the cable proximate to the connector, the reinforcement member extending partially along the cable to thereby define an end in the sheath between the ends of the cable;

disposing the electrical cable through an orifice defined by a collar;

advancing the connector toward the terminal of the printer in an axial direction and thereby electrically engaging the connector with the terminal of the printer;

advancing a first end of the collar toward the connector and the terminal; and engaging a connection feature of the collar to the terminal of the printer with the connector disposed at least partially between the collar and the terminal, and the collar disposed against the connector such that the engagement of the collar with the terminal prevents disengagement of the electrical connector from the terminal.

36. A method according to claim 35 wherein said step of engaging the connection feature comprises advancing the connection feature of the collar in an axial direction of the collar toward the terminal and rotating the connection feature relative to the terminal to thereby engage the connection feature with the terminal.

37. A method according to claim 35 wherein said step of engaging the connection feature comprises receiving at least a portion of the connector in the orifice of the collar such that a shoulder of the collar is disposed against a surface of the connector.

38. A method according to claim 35 further comprising connecting at least one electrical connector to an end of the cable opposite the first connector after said disposing step, wherein the orifice of the collar is smaller than the connectors at the opposite ends thereof such that the collar is retained on the cable between the ends of the cable.

39. A connection system for electrically engaging an electrical cable with an electrical connector to a terminal of a printer, the connection system comprising:

an electrical connector including a plurality of electrical contacts corresponding to the electrical contacts of the electrical terminal such that the electrical connector can be engaged to the electrical terminal;

an electrical cable including a tubular sheath and a plurality of conductive elements disposed in the sheath for electrical communication, the conductive elements being electrically connected to the electrical contacts of the electrical connector such that the plurality of conductive elements is electrically connected to the plurality of electrical contacts of the terminal, the electrical cable including a reinforcement member disposed in the sheath proximate to the connector and configured to support the cable proximate to the connector, the reinforcement member extending partially along the cable to thereby define an end in the sheath between the ends of the cable; and a collar extending in an axial direction from a first end to a second end and defining an orifice between the first and second ends with the cable disposed through the orifice and the orifice being smaller than a cross-sectional size of the electrical connector such that the collar is slidably mounted on the cable, wherein the collar defines a connection feature configured to engage the terminal with the cable extending through the orifice and the electrical connector disposed at least partially between the collar and the terminal such that the engagement of the collar with the terminal prevents disconnection of the electrical connector from the terminal.

40. A connection system according to claim 39 wherein the reinforcement member is a rigid member.

41. A connection system according to claim 39 wherein the reinforcement member is a polymer rod.

42. A connection system according to claim 39 wherein the reinforcement member is a metal rod.

43. A connection system according to claim 39 wherein the reinforcement member has a stiffness that is greater than the stiffness of the sheath and the conductive elements of the cable.

* * * * *

UNITED STATES PATENT AND TRADEMARK OFFICE

CERTIFICATE OF CORRECTION

PATENT NO. : 7,066,754 B2 
APPLICATION NO. : 10/901686
DATED : June 27, 2006
INVENTOR(S) : Beck et al.

It is certified that error appears in the above-identified patent and that said Letters Patent is hereby corrected as shown below:

Column 11,
Line 44, “form” should read --from--;
Line 56, “defying” should read --defining--.

Column 13,
Line 31, “correspond” should read --corresponding--;
Line 33, after “smaller” insert --than--.

Column 16,
Line 23, “bc” should read --be--.

Signed and Sealed this

Thirtieth Day of January, 2007

JON W. DUDAS
*Director of the United States Patent and Trademark Office*